US007513828B2

(12) United States Patent
Nguyen et al.

(10) Patent No.: US 7,513,828 B2
(45) Date of Patent: Apr. 7, 2009

(54) GAMING DEVICE HAVING SECONDARY GAME PLAYED IN PARALLEL WITH PRIMARY GAME

(75) Inventors: Binh T. Nguyen, Reno, NV (US); Craig A. Paulsen, Reno, NV (US)

(73) Assignee: IGT, Reno, NV (US)

( * ) Notice: Subject to any disclaimer, the term of this patent is extended or adjusted under 35 U.S.C. 154(b) by 718 days.

(21) Appl. No.: 10/780,088

(22) Filed: Feb. 17, 2004

(65) Prior Publication Data

US 2005/0181860 A1 Aug. 18, 2005

(51) Int. Cl.
*A63F 9/24* (2006.01)

(52) U.S. Cl. ..... 463/26

(58) Field of Classification Search ..... None
See application file for complete search history.

(56) References Cited

U.S. PATENT DOCUMENTS

| | | | |
|---|---|---|---|
| 2,743,108 | A | 4/1956 | Sanders |
| 3,904,207 | A | 9/1975 | Gold |
| 4,695,053 | A | 9/1987 | Vazquez, Jr. et al. |
| 4,775,155 | A | 10/1988 | Lees |
| 4,856,787 | A | 8/1989 | Itkis |
| 5,116,055 | A | 5/1992 | Tracy |
| 5,205,555 | A | 4/1993 | Hamano |
| 5,393,057 | A | 2/1995 | Marnell, II |
| 5,393,062 | A | 2/1995 | Cember |
| 5,407,200 | A | 4/1995 | Zalabak |
| 5,411,271 | A | 5/1995 | Mirando |
| 5,536,016 | A | 7/1996 | Thompson |
| 5,611,730 | A | 3/1997 | Weiss |
| 5,639,089 | A | 6/1997 | Matsumoto et al. |
| 5,641,730 | A | 6/1997 | Brown |
| 5,645,486 | A | 7/1997 | Nagao et al. |
| 5,755,619 | A | 5/1998 | Matsumoto et al. |
| 5,769,716 | A | 6/1998 | Saffari et al. |
| 5,788,573 | A | 8/1998 | Baerlocher et al. |
| 5,823,873 | A | 10/1998 | Moody |

(Continued)

FOREIGN PATENT DOCUMENTS

AU 738686 3/1999

(Continued)

OTHER PUBLICATIONS

Marshall Fey, Slot Machines, A Pictorial History of the First 100 Years, 1983, Liberty Belle Booke, Fifth Edition, pp. 74-75.*

(Continued)

*Primary Examiner*—Robert E. Pezzuto
*Assistant Examiner*—Omkar Deodhar
(74) *Attorney, Agent, or Firm*—Bell, Boyd & Lloyd LLP

(57) ABSTRACT

A gaming device having a primary game and a secondary game is provided. The gaming device includes a primary game operable upon a wager by a player, and a secondary game, wherein a play provides a gaming element for the secondary game. The gaming element of the secondary game is provided by playing the primary game regardless of any event or outcome in the primary game. The secondary game can achieve a winning outcome with the gaming elements provided by playing the primary game.

79 Claims, 13 Drawing Sheets

U.S. PATENT DOCUMENTS

| | | | | |
|---|---|---|---|---|
| 5,823,874 | A | | 10/1998 | Adams |
| 5,833,537 | A | | 11/1998 | Barrie |
| 5,848,932 | A | | 12/1998 | Adams |
| 5,851,148 | A | | 12/1998 | Brune et al. |
| 5,882,261 | A | | 3/1999 | Adams |
| 5,890,962 | A | | 4/1999 | Takemoto |
| 5,893,718 | A | | 4/1999 | O'Donnell |
| 5,927,714 | A | | 7/1999 | Kaplan |
| 5,935,002 | A | | 8/1999 | Falciglia |
| 5,947,820 | A | | 9/1999 | Morro et al. |
| 5,976,016 | A | | 11/1999 | Moody et al. |
| 5,980,384 | A | * | 11/1999 | Barrie ..... 463/16 |
| 5,997,401 | A | | 12/1999 | Crawford |
| 6,007,066 | A | | 12/1999 | Moody |
| 6,015,346 | A | | 1/2000 | Bennett |
| 6,019,369 | A | | 2/2000 | Nakagawa et al. |
| 6,033,307 | A | | 3/2000 | Vancura |
| 6,056,642 | A | | 5/2000 | Bennett |
| 6,059,289 | A | | 5/2000 | Vancura |
| 6,059,658 | A | | 5/2000 | Mangano et al. |
| 6,089,976 | A | | 7/2000 | Schneider et al. |
| 6,089,978 | A | | 7/2000 | Adams |
| 6,093,102 | A | | 7/2000 | Bennett |
| 6,102,798 | A | | 8/2000 | Bennett |
| 6,113,098 | A | | 9/2000 | Adams |
| 6,120,377 | A | | 9/2000 | McGinnis, Sr. et al. |
| 6,126,542 | A | | 10/2000 | Fier |
| 6,126,547 | A | | 10/2000 | Ishimoto |
| 6,135,884 | A | | 10/2000 | Hedrick et al. |
| 6,142,873 | A | | 11/2000 | Weiss et al. |
| 6,159,095 | A | | 12/2000 | Frohm et al. |
| 6,159,096 | A | | 12/2000 | Yoseloff |
| 6,159,097 | A | | 12/2000 | Gura |
| 6,159,098 | A | | 12/2000 | Slomiany et al. |
| 6,179,710 | B1 | | 1/2001 | Sawyer et al. |
| 6,186,894 | B1 | | 2/2001 | Mayeroff |
| 6,234,900 | B1 | | 5/2001 | Cumbers |
| 6,270,412 | B1 | | 8/2001 | Crawford et al. |
| 6,302,793 | B1 | | 10/2001 | Fertitta, III et al. |
| 6,311,976 | B1 | * | 11/2001 | Yoseloff et al. ..... 273/138.2 |
| 6,315,660 | B1 | * | 11/2001 | DeMar et al. ..... 463/16 |
| 6,319,125 | B1 | | 11/2001 | Acres |
| 6,322,309 | B1 | | 11/2001 | Thomas et al. |
| 6,347,996 | B1 | | 2/2002 | Gilmore et al. |
| 6,368,216 | B1 | | 4/2002 | Hedrick et al. |
| 6,393,057 | B1 | | 5/2002 | Thoreau et al. |
| 6,398,218 | B1 | | 6/2002 | Vancura |
| 6,398,644 | B1 | | 6/2002 | Perrie et al. |
| 6,428,412 | B1 | | 8/2002 | Anderson et al. |
| 6,443,837 | B1 | | 9/2002 | Jaffe et al. |
| 6,461,241 | B1 | | 10/2002 | Webb et al. |
| 6,464,582 | B1 | | 10/2002 | Baerlocher et al. |
| 6,481,713 | B2 | | 11/2002 | Perrie et al. |
| 6,482,089 | B2 | | 11/2002 | DeMar et al. |
| 6,533,658 | B1 | | 3/2003 | Walker et al. |
| 6,547,242 | B1 | | 4/2003 | Sugiyama et al. |
| 6,607,438 | B2 | | 8/2003 | Baerlocher et al. |
| 6,609,971 | B2 | | 8/2003 | Vancura |
| 6,638,167 | B1 | | 10/2003 | Sawyer et al. |
| 6,645,073 | B2 | | 11/2003 | Lemay et al. |
| 6,652,378 | B2 | | 11/2003 | Cannon et al. |
| 6,656,040 | B1 | | 12/2003 | Brosnan et al. |
| 6,682,419 | B2 | | 1/2004 | Webb et al. |
| 6,682,420 | B2 | | 1/2004 | Webb et al. |
| 6,722,985 | B2 | | 4/2004 | Criss-Puszkiewicz et al. |
| 6,729,956 | B2 | | 5/2004 | Wolf et al. |
| 6,733,389 | B2 | | 5/2004 | Webb et al. |
| 6,739,973 | B1 | | 5/2004 | Lucchesi et al. |
| 6,837,788 | B2 | | 1/2005 | Cannon |
| 6,857,958 | B2 | | 2/2005 | Osawa |
| 6,981,917 | B2 | | 1/2006 | Webb et al. |
| 7,094,147 | B2 | * | 8/2006 | Nakata et al. ..... 463/9 |
| 7,169,046 | B2 | | 1/2007 | Webb et al. |
| 7,297,058 | B2 | * | 11/2007 | Gomez et al. ..... 463/16 |
| 2002/0045472 | A1 | | 4/2002 | Adams |
| 2002/0094855 | A1 | | 7/2002 | Berman |
| 2002/0198036 | A1 | | 12/2002 | Baerlocher et al. |
| 2003/0064772 | A1 | | 4/2003 | Tempest et al. |
| 2003/0064785 | A1 | | 4/2003 | Stone et al. |
| 2003/0069064 | A1 | | 4/2003 | Ainsworth |
| 2003/0078089 | A1 | | 4/2003 | Gray et al. |
| 2003/0104860 | A1 | | 6/2003 | Cannon et al. |
| 2003/0157979 | A1 | | 8/2003 | Cannon et al. |
| 2003/0207709 | A1 | | 11/2003 | Paotrakul |
| 2003/0207710 | A1 | | 11/2003 | Rodgers et al. |
| 2004/0029631 | A1 | | 2/2004 | Duhamel |
| 2004/0053673 | A1 | | 3/2004 | Mishra |
| 2004/0053683 | A1 | | 3/2004 | Hartl et al. |
| 2004/0072619 | A1 | | 4/2004 | Brosnan et al. |
| 2004/0106446 | A1 | | 6/2004 | Cannon et al. |
| 2004/0152509 | A1 | | 8/2004 | Hornik et al. |
| 2005/0014554 | A1 | | 1/2005 | Walker et al. |
| 2005/0037838 | A1 | | 2/2005 | Dunaevsky et al. |

FOREIGN PATENT DOCUMENTS

| | | | | |
|---|---|---|---|---|
| EP | 0 449 433 | | | 10/1991 |
| EP | 0 874 337 | | | 10/1998 |
| EP | 0 945 837 | | | 9/1999 |
| EP | 0 984 408 | | | 3/2000 |
| EP | 0 984 409 | | | 3/2000 |
| GB | 2 117 952 | | | 10/1983 |
| GB | 2 137 392 | A | | 10/1984 |
| GB | 2 170 636 | A | | 8/1986 |
| GB | 2170636 | A | * | 8/1986 |
| GB | 2 191 030 | | | 12/1987 |
| WO | WO 00/12186 | | | 3/2000 |
| WO | WO 2004/078297 | A1 | | 9/2004 |

OTHER PUBLICATIONS

Bingo Game Brochure written by Casino Data System, published in 1998.
Fortune Cookie Brochure written by IGT, published in 2000.
Full House Brochure written by Anchor Games, published in 2000.
Jackpot Bingo written by CDS.com, printed Apr. 12, 2001.
Jewel in the Crown Brochure written by Barcrest, Ltd, published date unknown.
Match Reel Game Bonus Description written by IGT, published date unknown.
Plinko Showcase Show Down written by International Game Technology, published in 2001.
Slot Bingo Wagering Description and Paytable written by IGT, published before Sep. 30, 2004.
Take Your Pick Brochure written by Anchor Games, published in 1999.
Tetris Game Description written by Radica, published in 2000.
Top Dollar Brochure written by IGT, published in 1999.

* cited by examiner

GAMING DEVICE HAVING SECONDARY GAME PLAYED IN PARALLEL WITH PRIMARY GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufacturers strive to make gaming devices that provide as much enjoyment and excitement as possible. Providing a secondary or bonus game in which a player has an opportunity to win potentially large awards or credits in addition to awards associated with the primary or base game of the gaming device is one known method for enhancing player enjoyment and excitement.

Gaming devices having secondary or bonus games generally employ a triggering event that occurs during the operation of the base game of the gaming device. As the result of reaching a predetermined outcome in the base game, the triggering event temporarily stalls or halts the play of the base game and enables a player to enter a second, different game (i.e., a secondary or bonus game). For example, in slot machines with reels, the triggering event usually occurs when the player reaches a predetermined combination of symbols on the reels. The player plays the secondary game, likely receives an award, and returns to the base game.

Moreover, known gaming devices have a bonus or secondary game that is played over the course of a number of plays of the primary or base game. These gaming devices award the player for their persistence in playing the gaming device for a prolonged number of plays or period of time. In these games, each time the base game advances to the bonus game, a portion of the bonus game is played or at least one bonus game element is provided to the player and then the player returns to the base game. After the player has advanced to the bonus game a number of times (i.e., obtained a number of bonus game elements), an award is provided to the player. The bonus game outcome is awarded to the player based on a plurality of plays of the bonus game which occur based on triggering events in the primary game.

The player's enjoyment increases by playing the secondary game in addition to the primary game. However, reaching the predetermined outcome in the base game to advance to the secondary game often occurs intermittently and infrequently. Thus, it is desirable to have a gaming device that provides an opportunity for the player to play the secondary game simultaneous with the play of the primary game regardless of the outcome of the primary game.

SUMMARY OF THE INVENTION

The present invention relates to a gaming device having a secondary game that is played simultaneously with the primary game operable upon a wager by a player. In one embodiment, the gaming device provides a primary game that enables the player to play a secondary game independent of any event or outcome in the primary game. In one embodiment, a number of plays of the primary game each provide a gaming element for a simultaneously played secondary game. That is, simply by playing a primary game, at least one gaming element of a secondary game is provided regardless of any event or outcome that occurs in the primary game. The number of elements provided with each such play may remain constant or may vary, and may be predetermined or randomly determined. This allows a player to participate in two preferably different games simultaneously, thereby enhancing the gaming experience. It should be appreciated that providing the player with gaming elements of the secondary game regardless of any event or outcome that occurs in the primary game increases the player's enjoyment and level of excitement, in particular in part because a positive component of the secondary game can be provided when a losing outcome in the primary game is provided and vice versa.

In one embodiment, the gaming elements of the secondary game are provided at a rate associated with the number of times the primary game is played. That is, at least one secondary game gaming element may be provided each time the primary game is played, every other time the primary game is played or based on any other suitable predetermined or randomly determined frequency of plays of the primary game. In an alternative embodiment, the gaming elements of the secondary game are associated with an amount wagered in the primary game. That is, the number of provided secondary game gaming elements or the frequency in which the secondary game gaming elements are provided may be based on the amount wagered in the primary game.

In one embodiment, the secondary game randomly determines a winning outcome or award based on the gaming elements provided for playing the primary game. In another embodiment, to obtain a winning outcome or award in the secondary game, at least one player decision must be made regarding the provided gaming elements. Various suitable awards and suitable pay tables can be associated with the play of the primary and secondary games. In one embodiment, the secondary pay table may correspond to a winning display or predetermined outcome in the primary game. In another embodiment, the secondary pay table may correspond to a wager made in the primary game. The secondary pay table may increase accordingly with a single wager or a series of wagers by the player. Alternatively, the second pay table may correspond to a wager made in the secondary game.

The secondary or bonus game may be any type of suitable game. It can be the same as, similar to or completely different from the primary game. For example, the secondary game can be a TETRIS™ style game or a card game such as poker or blackjack. The secondary game can also be based on a risk, skill, random or knowledge event.

In one embodiment of the gaming device, a wager may be placed on the secondary game that is separate and independent from any wager placed on the primary game. In an alternative embodiment, the secondary game wager may be placed before or during play of the secondary game. In another embodiment, an award from the primary game, if any, may be used as a separate wager for the secondary game.

In one embodiment, the award from the secondary game, if any, is added to the primary game award the player has already won. In another embodiment, the secondary award is added to the primary game award the player may win if a predetermined winning outcome is achieved in the primary game. In another embodiment, the secondary game award is added directly to the player's account, regardless of the outcome of the primary game.

Additional features and advantages of the present invention are described in, and will be apparent from, the following Detailed Description of the Invention and the figures.

BRIEF DESCRIPTION OF THE FIGURES

FIG. 2B is a schematic diagram of the data network that one or more of the gaming devices of the present invention may be connected to.

DETAILED DESCRIPTION OF THE INVENTION

General Gaming Device

Figure 1A:
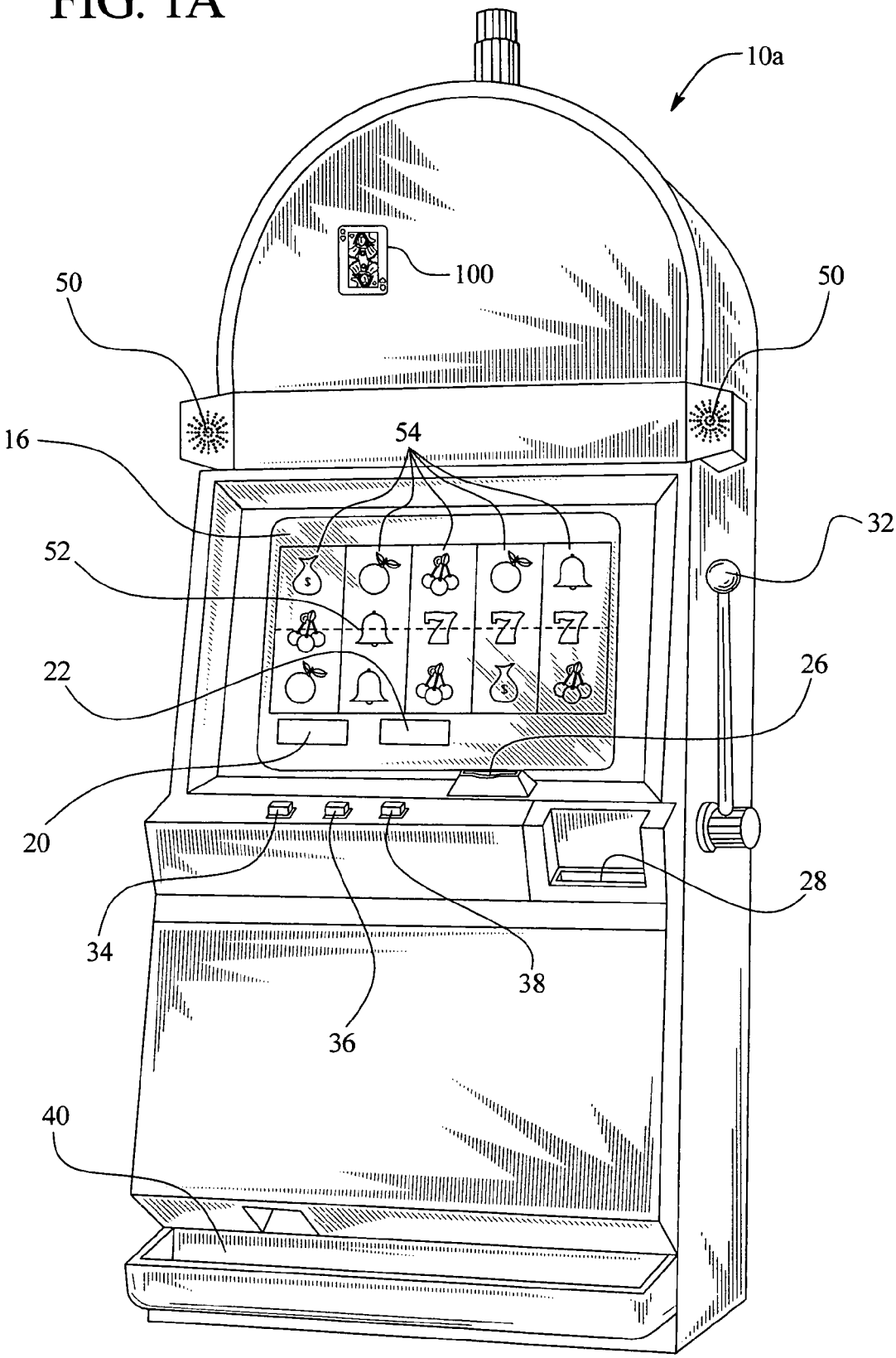
FIGS. 1A and 1B are perspective views of alternative embodiments of the gaming device of the present invention.
Figure 1B:
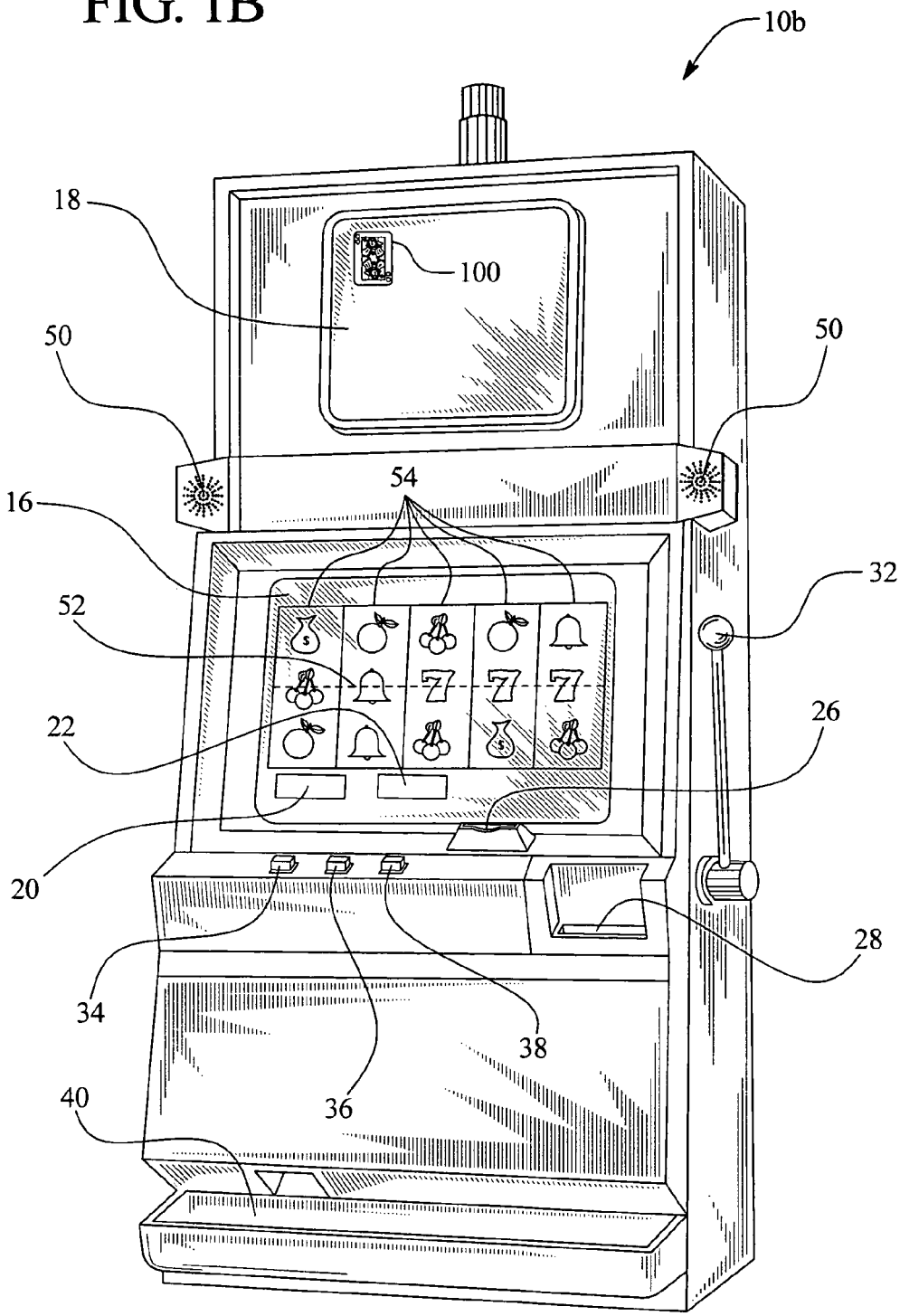

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
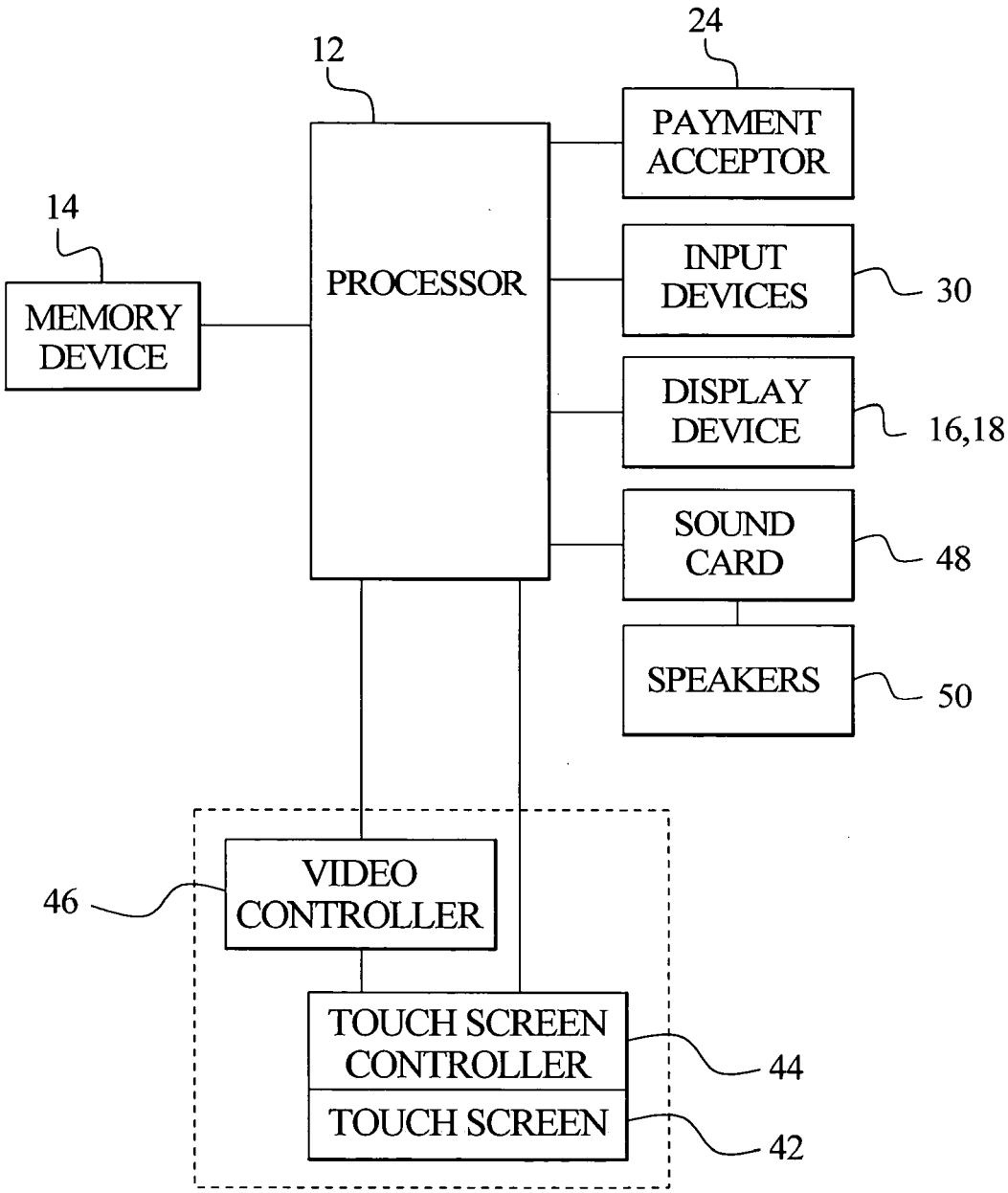
FIG. 2A is a schematic diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or other operating data, information and applicable game rules that relate to the play of the gaming device. In another embodiment, the memory device includes random access memory (RAM). In one embodiment, the memory device includes read only memory (ROM). In a further embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk, CD ROM, smartcard, memory stick, Compact Flash memory module or USB removable flash drive. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. In this type of embodiment, the gaming device provides players with all of the available awards or other game outcomes over the course of the play cycle and guarantees a designated amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables at least a portion of the primary or secondary game to be played at a location remote from the gaming device. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical form. That is, the display device may include any suitable electromechanical device which preferable moves one or more mechanical objects, such as one or more mechanical rotatable wheels, reels or dice, configured to display at least one and preferably a plurality of games or other suitable images, cards, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a maximum bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game associated with the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips which are redeemable by a cashier or funded to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Figure 2B:
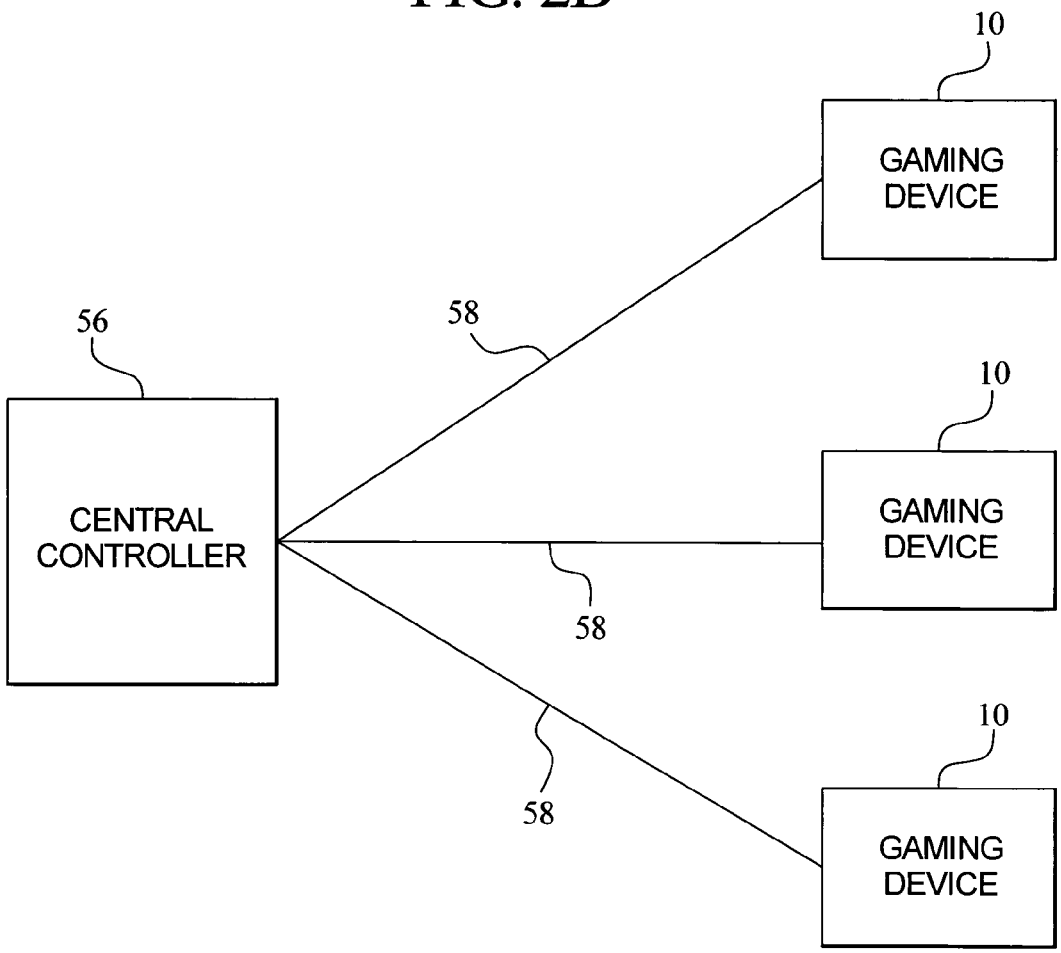

In one embodiment, as illustrated in FIG. 2B, one or more of the gaming devices 10 of the present invention may be connected to a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

The gaming device can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. The primary game can also involve a risk, skill, or knowledge based event. That is, different primary wagering games, such as video poker games, video blackjack games, video keno, video bingo or any other suitable primary or base game may be implemented into the present invention. It should be appreciated that regardless of which primary or base game is utilized, the gaming device of the present invention enables the player to play a simultaneous secondary game independent of any event or outcome in the primary or base game. That is, for playing the primary game, the gaming device provides at least one gaming element to be used for the secondary game.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one reel and preferably a plurality of reels 54, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above. Each reel displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning combination or pattern.

In one embodiment, a base or primary game may be a poker game wherein the gaming device enables the player to play a conventional game of video poker and initially deals five cards, all face up, from a virtual deck of fifty-two cards. Cards may be dealt as in a traditional game of cards or in the case of the gaming device, the cards may be randomly selected from a predetermined number of cards. If the player wishes to draw, the player selects the cards to hold by using one or more input devices, such as pressing related hold buttons or touching a corresponding area on a touch-screen. After the player presses the deal button, the processor of the gaming device removes the unwanted or discarded cards from the display and deals replacement cards from the remaining cards in the deck. This results in a final five-card hand. The processor of the gaming device compares the final five-card hand to a payout table which utilizes conventional poker hand rankings to determine the winning hands. Award based on a winning hand and the credits wagered is provided to the player.

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferably a plurality of the selectable indicia or numbers by using an input device or by using the touch-screen. The gaming device then displays a series of drawn numbers to determine an amount of matches, if any, between the player's selected numbers and the gaming device's drawn numbers. The player is provided an award, if any, based on the amount of determined matches.

Gaming Device Having Secondary Game Played In Parallel With Primary Game

As described in more detail below, in addition to winning credits in a base or primary game, the gaming device simultaneously provides players the opportunity to win credits in a bonus or secondary game or round independent of any event or outcome that occurs in the base or primary game. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either the same, similar to or completely different from the base or primary game. In one embodiment, the bonus or secondary game includes any suitable electromechanical device to play the secondary or bonus game. In another embodiment, the bonus or secondary game is displayed and played on one or more display deices controlled by the processor.

In one embodiment, the gaming device includes a program code which causes the processor to automatically begin or initiate a bonus game simultaneous with the play of the base or primary game. In another embodiment, the gaming device begins or initiates the bonus game when the player has achieved a suitable triggering event or a qualifying condition. For example, the qualifying condition may be an amount wagered on the base or primary game, a number of plays of the base or primary game or based on a random event independent of the play of the primary game. It should be appreciated that in this embodiment, once the bonus or secondary game begins, the bonus game is played simultaneous with at least one and preferably a plurality of subsequent plays of the base or primary game.

In one embodiment, no separate entry fee or buy in for a bonus game need be employed. That is, a player may not purchase an entry into a bonus game. The player must earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities. In another embodiment, a player may partially buy in for a bonus game. That is, entry in the bonus game may be accomplished by a combination of play the primary game and the employment of an entry or buy in fee.

In one embodiment, a separate wager can be made in the secondary game that is distinct from any wager made in the primary game. The wager may be placed on the secondary game before or after the gaming elements for the secondary game are provided to the player. Accordingly, the secondary award can be based on the wager made in the secondary game. In another embodiment, the player may use an award from the primary game as a separate wager for the secondary game.

Once the bonus or secondary game is initiated, the secondary game is played simultaneously with and independent of at least one and preferably a plurality of plays of the primary game. That is, simply for playing the primary game, at least one gaming element of the secondary game is provided to the player regardless of any event or outcome that occurs in the primary game. In another embodiment, for playing the primary game, a plurality of gaming elements of the secondary game are provided to the player regardless of any event or outcome that occurs in the primary game. The number of gaming elements provided can be predetermined, randomly determined, based on the wager or otherwise suitably determined. An outcome for the secondary game is ultimately provided to the player based on the gaming elements provided for playing the primary game.

In one embodiment, the gaming elements provided for playing the primary game are randomly determined. In another embodiment, the gaming elements provided for playing the primary game are selected from a plurality of gaming elements. In another embodiment, the provided gaming elements are selected from one or more pools of secondary game gaming elements. In another embodiment, the gaming elements provided for playing the primary game are predetermined or provided in a predetermined order.

In one embodiment, the secondary game may be operable the entire time the primary game is played. In another embodiment, the secondary game is operable for part of the time the primary game is played. In this embodiment, the secondary game may intermittently provide a secondary gaming element as the primary game is triggered.

In one embodiment, each of a designated number of plays of the primary game (i.e., one or more) provides at least one gaming element for the secondary game. That is, at least one secondary game gaming element may be provided, each time the primary game is played, every other time the primary game is played or based on any other suitable frequency of plays of the primary game. In another embodiment, each of a designated number of plays of the primary game provides a plurality of gaming elements of the secondary game.

In another embodiment, the gaming elements of the secondary game are associated with an amount wagered in the primary game. That is, the number of secondary game gaming elements provided to the player may be based on the amount wagered in the primary game. Moreover, the frequency in which the secondary game gaming elements are provided to the player may also be based on the amount wagered in the primary game. For example, two or more secondary game gaming elements may be provided to the player every time a maximum wager is placed or a wager above a specified amount is placed. It should be appreciated that supplying additional secondary game gaming elements for play in a secondary game based on higher wagers may increase the chances that the player obtains a winning outcome in the secondary game.

As a plurality of primary games are played and the provided gaming elements accumulate, an outcome is ultimately provided to the player based on the provided gaming elements. In this manner, a secondary game winning outcome can be achieved and an award associated with the achieved winning outcome can be provided just by playing the primary game regardless of any event or outcome in the primary game. Thus, it is possible for the player to win an award or multiple awards from the secondary game without winning any award from the primary game.

In one embodiment, the gaming device determines a secondary game outcome based on the accumulated gaming elements. In another embodiment, the gaming device randomly determines an outcome of the secondary game based in part on the provided gaming elements. In another embodiment, the gaming device randomly determines a secondary game outcome. That is, regardless of the accumulated gaming elements, the gaming device randomly determines a secondary game outcome.

In another embodiment, the secondary game outcome is based on the provided gaming elements and at least one player decision regarding the gaming elements. That is, the secondary game is at least in part based on the player's risk, skill or knowledge. In this manner, the player's decision can help determine whether the secondary game achieves a winning outcome. In another embodiment, the secondary game outcome is based on the provided gaming elements and a plurality of player decisions regarding the gaming elements.

Although the secondary game can achieve a winning outcome regardless of any event in the primary game, the player is able to derive further satisfaction if the primary game and the secondary game achieve a winning outcome. When this occurs, the primary game and secondary game can award a player in numerous ways. In one embodiment, the award from the secondary game is added to the primary game award. In another embodiment, the secondary award is added to the primary game award the player may win if a predetermined winning outcome in the primary game is achieved. This essentially increases the payout of the primary game once a winning outcome is achieved. In another embodiment, the secondary game award is added directly to the player's account.

In one embodiment, the secondary game can have an associated pay table offering various awards that is dependent on the primary game. In one embodiment, the secondary pay table may correspond to a winning display or predetermined outcome in the primary game. For example, the secondary pay table can start out with a set of initial awards. While playing the primary game, the secondary game provides gaming elements in order to achieve a winning outcome in the secondary game and one of the awards from the secondary pay table. If a winning display in the primary game is achieved, the secondary pay table may increase as a result. Thus, the secondary game can provide an award greater than the amount that was initially displayed in the secondary pay table at the outset of the game play.

In another embodiment, the secondary pay table may correspond to a wager made in the primary game. The secondary pay table may increase accordingly with a single wager or a series of wagers by the player. Alternatively, the secondary pay table may correspond to a wager made in the secondary game that is distinct from any wager made in the primary game.

In one embodiment, the secondary game may maintain its status after play of the primary game is stopped and the player has cashed out any remaining credits. In this embodiment, the secondary game may maintain the same status until another player initiates the primary game. Consequently, a new player may reap the benefits of a player who has previously played the primary game but did not win a prize in the secondary game. Alternatively, the secondary game may eliminate all of its gaming elements once a player has cashed out so that the next user begins anew with no secondary gaming elements.

In an alternative embodiment, the gaming device includes a plurality of secondary games that are each played simultaneously with and independent of the primary game. In one embodiment, each of the secondary games are different. In another embodiment, a plurality of the secondary games are different. In another embodiment, each of the plurality of secondary games are the same. In one embodiment, as the primary game is played, the gaming device provides a secondary gaming element for one of the plurality of secondary games. In another embodiment, as the primary game is played, the gaming device provides secondary gaming elements for a plurality of the secondary games. In another embodiment, as the primary game is played, the gaming device provides secondary gaming elements for each of the plurality of secondary games. In another embodiment, as the primary game is played, the gaming device randomly determines which of the plurality of secondary games is provided a secondary gaming element. In another embodiment, the player is enabled to select which of the plurality of secondary games is provided a secondary gaming element.

Figure 3A:
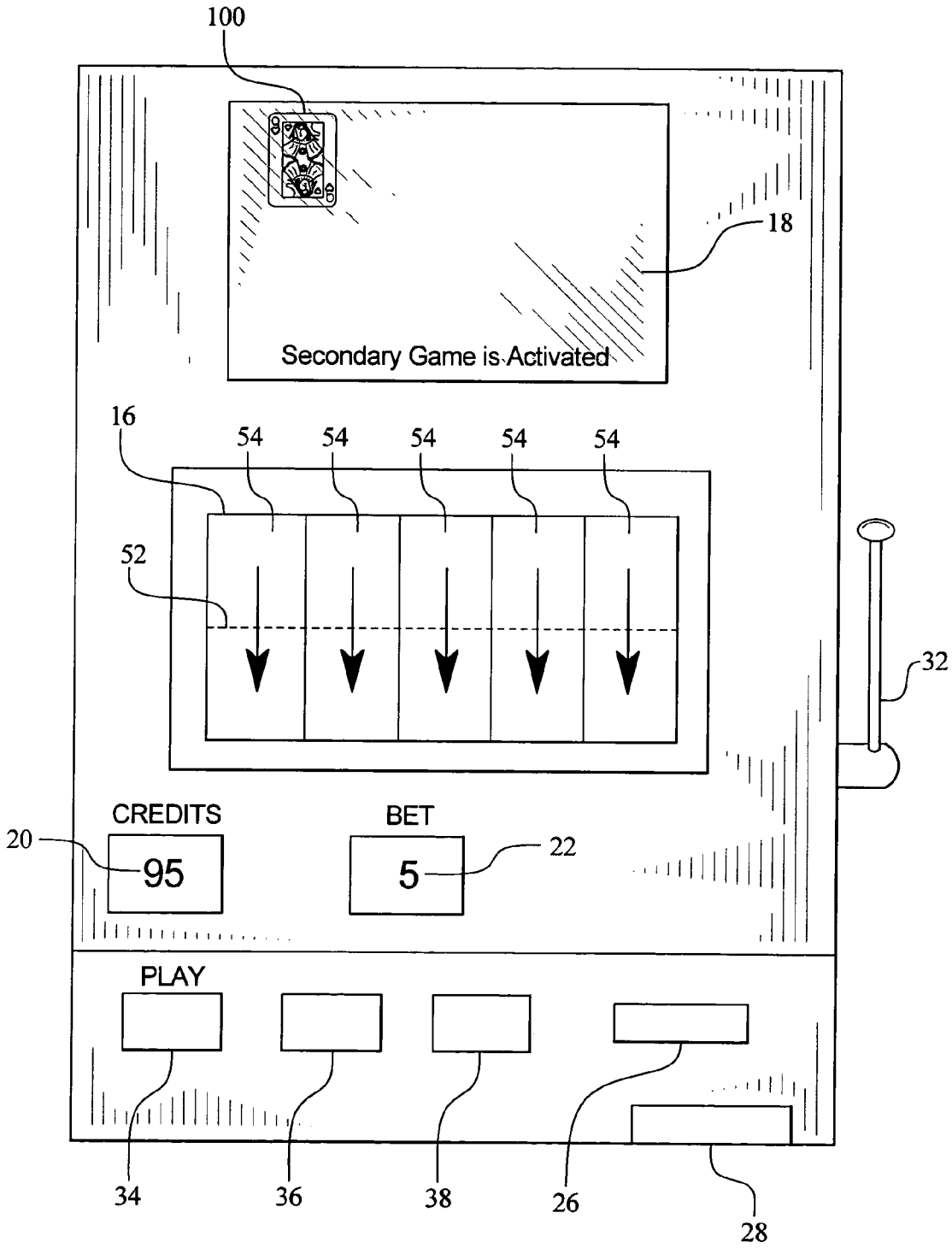
FIGS. 3A, 3B, and 3C are elevation views of the display device of the present invention illustrating one slot machine embodiment progression of a primary slot game event and a secondary card game event of the gaming device of the present invention having a winning outcome as the primary game is being played.

Referring now to FIGS. 1A, 1B and 3A, one method for playing a secondary poker card game in parallel with a primary slot game is illustrated. Upon a triggering event of the primary game, the reels spin and the secondary game is initiated. While the reels are spinning, a first game card 100 of the secondary game is provided, in this case a Queen of Hearts. In this embodiment, the gaming elements or cards are any card from a typical deck of cards. It should be appreciated that the reels are shown spinning because the secondary game provides the secondary gaming element once the primary game is initiated, regardless of any event or outcome of the primary game. That is, the player is provided a secondary gaming element simply for playing the primary game.

Figure 3B:
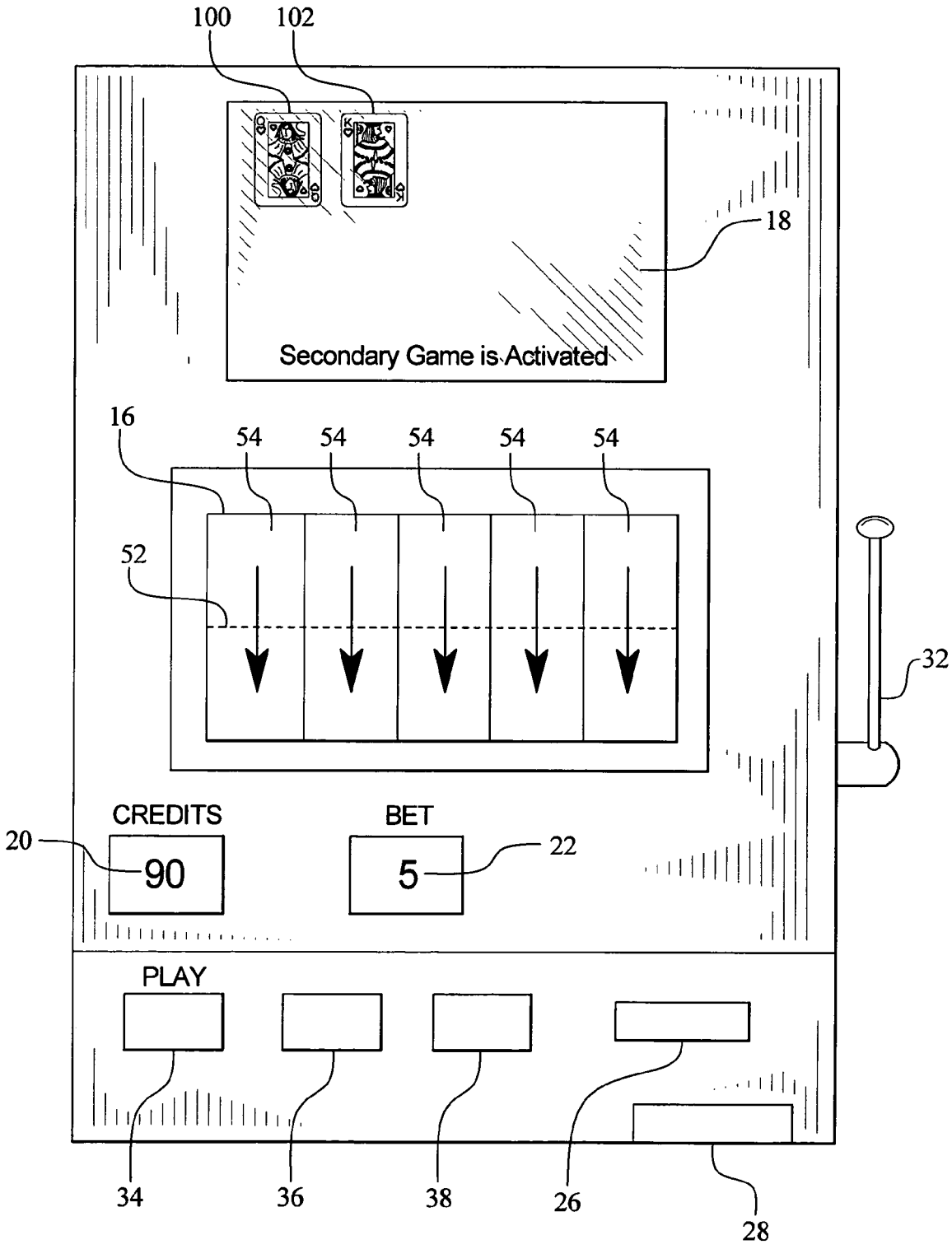

As seen in FIG. 3B, upon another play of the primary reel game (i.e., after the outcome of the previous primary reel game is determined and the player initiates another spin of the reels) and while the reels are spinning, another card of the secondary game 102 is provided independent of any outcome of the primary game. In this case, the next card or gaming element of the secondary game is the King of Hearts which joins the previously provided Queen of Hearts card or gaming element.

Figure 3C:
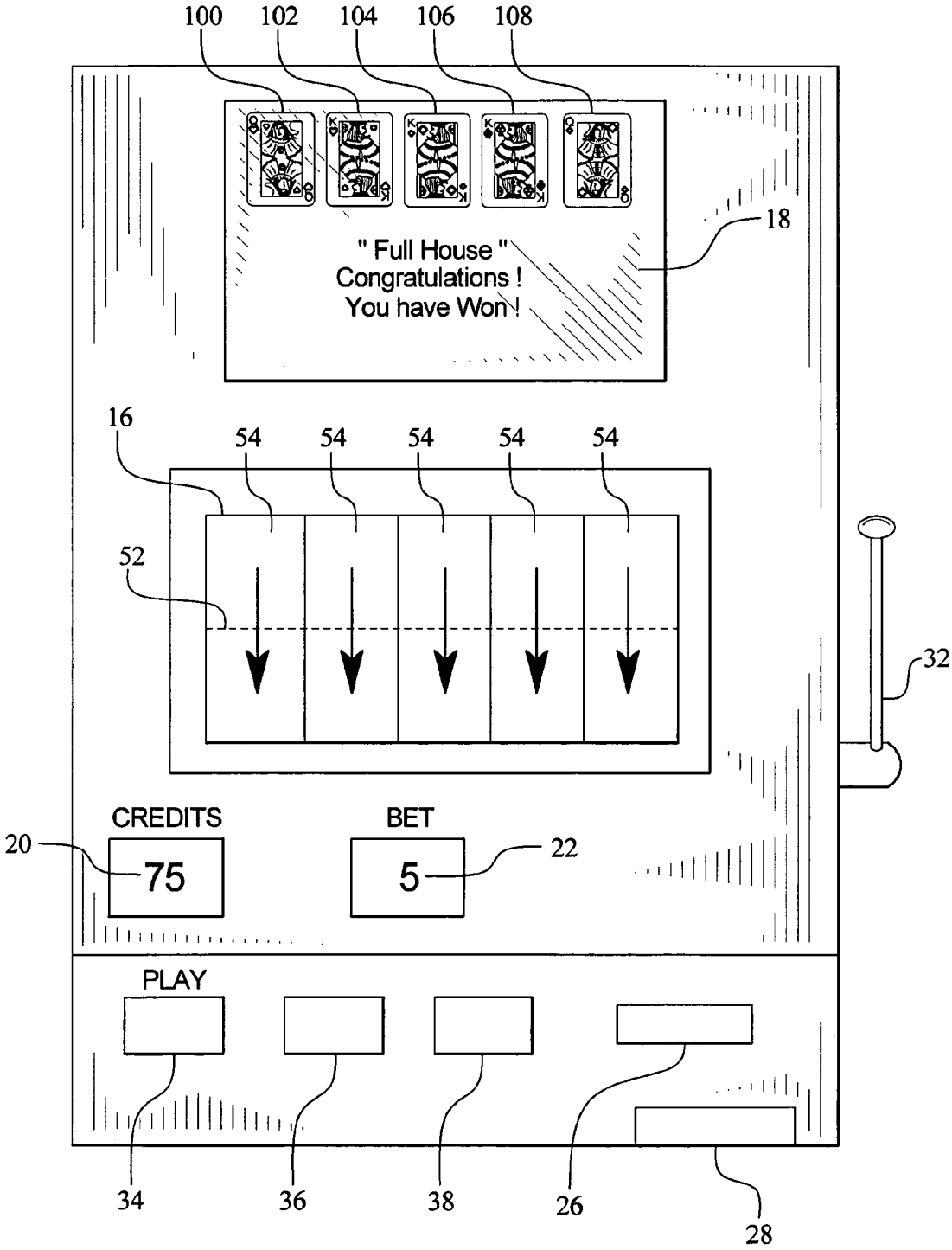

FIG. 3C illustrates the secondary game after a plurality of additional plays of the primary game. As illustrated, three additional gaming elements or cards have been provided for additional plays of the primary game and the five gaming elements or cards accumulate to display a full house. According to an appropriate pay table for the secondary game, the full house constitutes a winning secondary game outcome and thus an award is provided to the player regardless of any outcome or event of the primary game.

Figure 4:
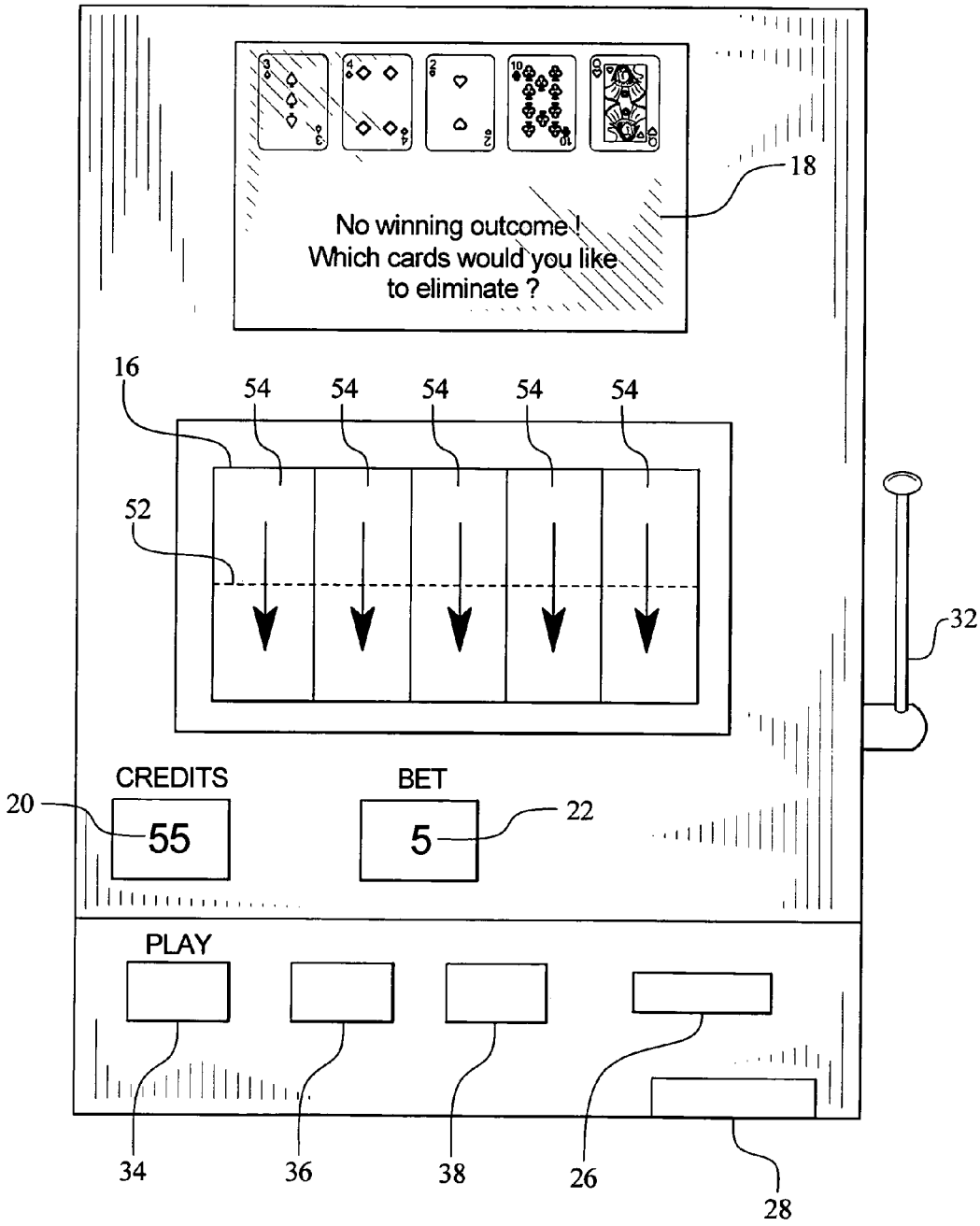
FIG. 4 is an elevation view of the display device of the present invention illustrating one slot machine embodiment of a primary slot game event and a secondary card game event of the gaming device of the present invention wherein a complete set of cards is obtained but the secondary card game has not achieved a winning outcome.

As illustrated in FIG. 4, in one embodiment, when the predetermined set of gaming elements or cards is complete and a winning outcome is not obtained, the gaming elements or cards may be replaced one or more at a time. Thus, in one embodiment the secondary game can allow users to eliminate gaming elements and new gaming elements are provided in their place as the primary game is continuously played. In this manner, the secondary game can provide gaming elements until a winning outcome is obtained. In this embodiment, even after the secondary game achieves a winning outcome, the secondary game can be played as long as the primary game is played. In another embodiment, if a winning combination does not occur, the secondary game ends and is reset without a win.

Figure 5A:
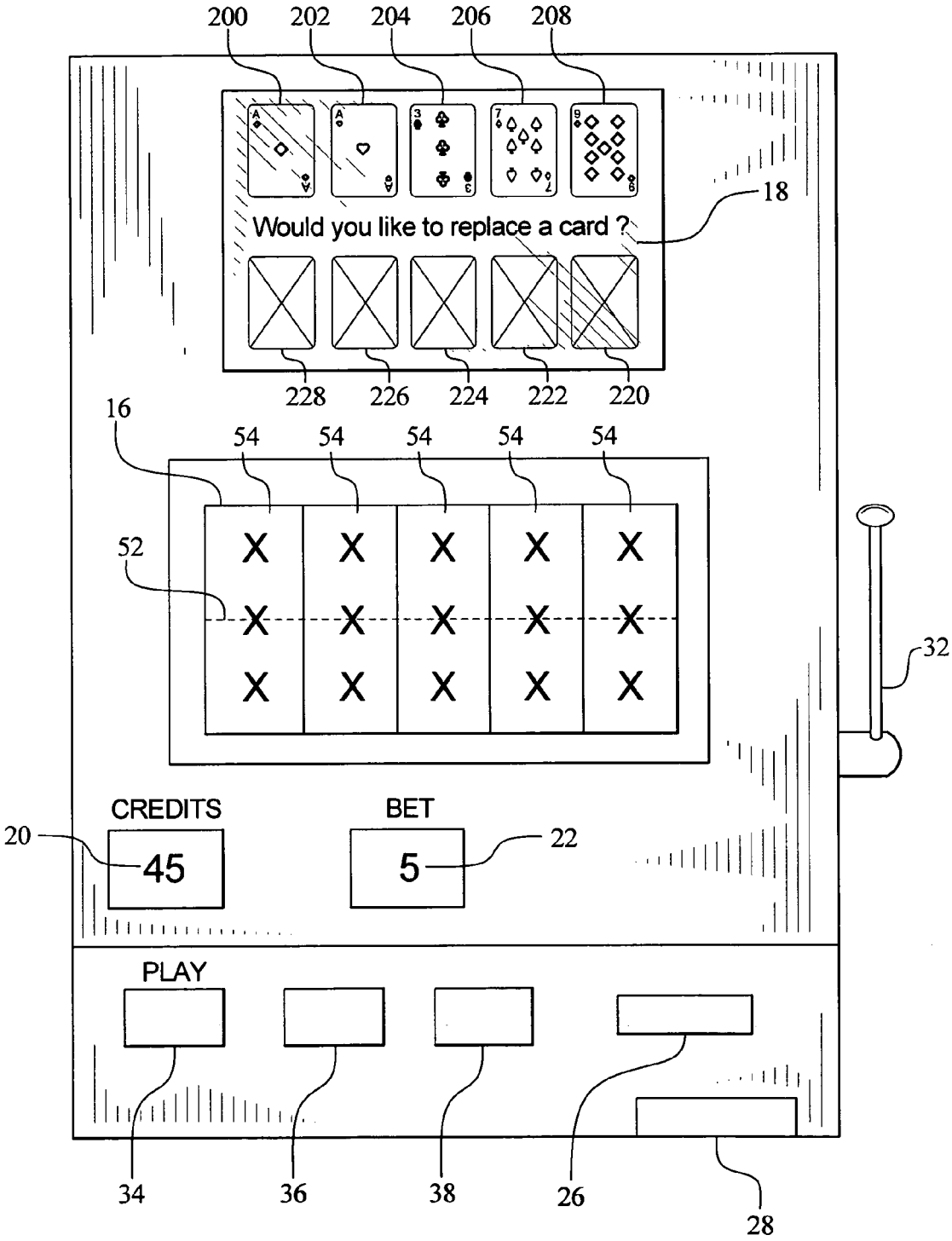
FIGS. 5A, 5B, and 5C are elevation views of the display device of the present invention illustrating one slot machine embodiment progression of a primary slot game event and a secondary card game event of the gaming device of the present invention wherein a player makes a decision regarding a set of cards obtained in the secondary card game and obtains a winning set versus the set held by the secondary card game.

Referring now to FIG. 5A, in another embodiment, the player's decision regarding the provided secondary game gaming elements can help determine whether the player is provided a winning outcome for the secondary game. For example, if the secondary card game is five card draw, the primary game can be played until five gaming elements or game cards are provided in the secondary game independent of any outcome or event occurring in the primary game. In this embodiment, the gaming elements or cards of Ace of Diamonds, Ace of Hearts, Three of Clubs, Seven of Spades and Nine of Diamonds, 200, 202, 204, 206 and 208, respectively, are provided based on the player repeatedly playing the primary game.

In this embodiment, a plurality of gaming element or cards, representing the hand of the house or gaming device may also be provided at any time. This house hand provides an element a competition in the secondary game. That is, in order to obtain an award in the secondary game, the player's hand of cards (i.e., accumulated gaming elements) must beat the house hand. In this embodiment, five masked cards 220, 222, 224, 226 and 228 are provided.

Figure 5B:
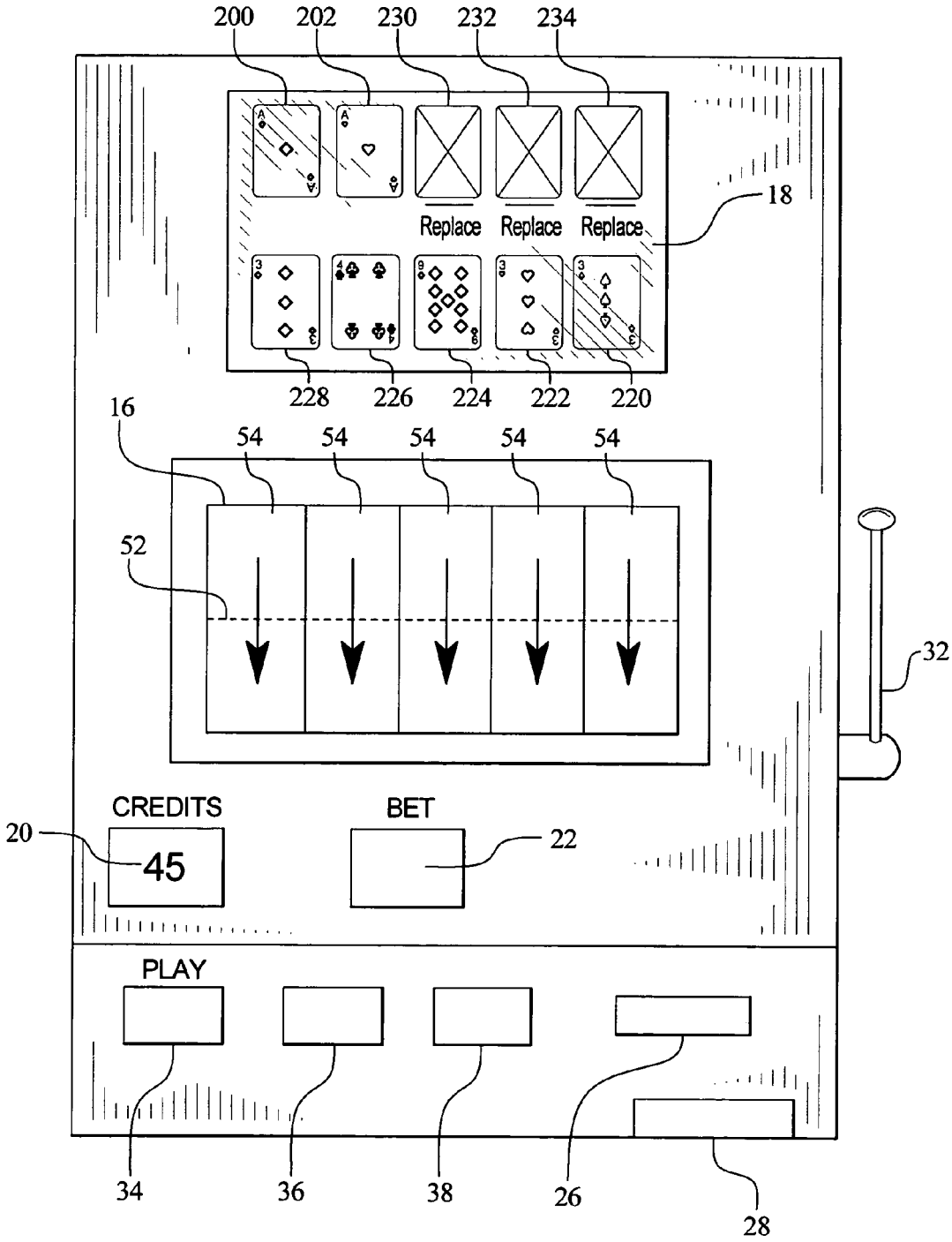

As illustrated in FIG. 5B, after a plurality of secondary game gaming elements or cards have been provided to the player (i.e., for a plurality of plays of the primary game), the hand of the house is revealed to the player. In this case, the secondary game house hand includes three 3's. As the player needs three of a kind with cards higher than a three to win the hand and the player currently does not hold such a hand, the player may decide to replace any or all of the cards by continuing to play the primary game. As the player already holds two Aces 200 and 202, the player may choose gaming elements or cards 204, 206 and 208 to be removed. Once the chosen gaming elements are removed, the primary game is subsequently played and additional secondary game gaming elements are provided.

Figure 5C:
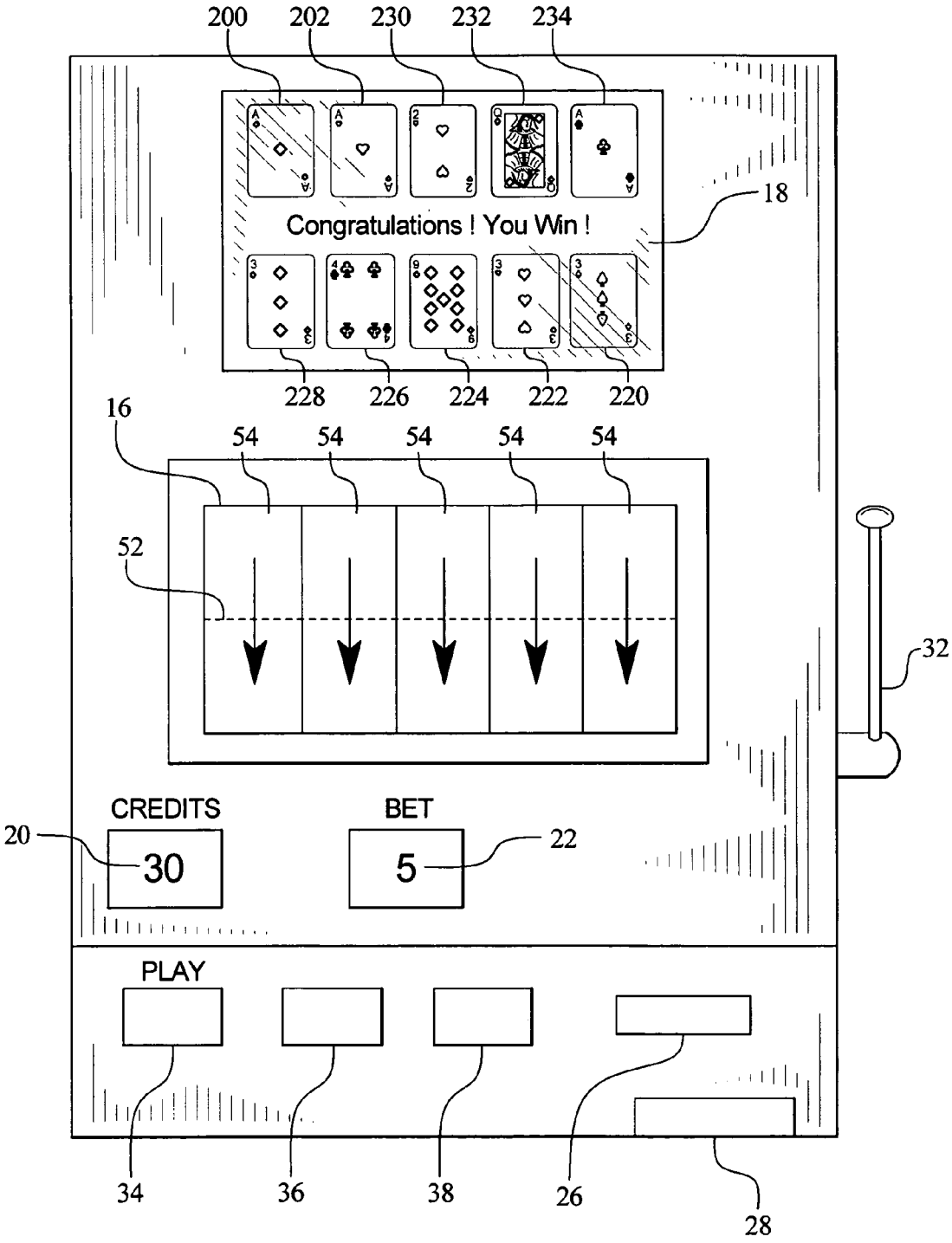

As illustrated in FIG. 5C, new gaming elements or cards 230, 232 and 234 replace the removed gaming elements or cards. As one of the replacement cards is another Ace, the player's hand beats or trumps the house's hand and thus the player obtains a winning outcome for the secondary game.

An alternative embodiment of this device may allow any cards to be replaced after completing an initial set of cards without continually playing the primary game. Another embodiment may require that the primary game be continually played in order to replace the initial set of cards. Ultimately, once the player's final decision for the hand is complete, the player's cards will be compared to the house. The secondary card game can provide an award if the player has a higher hand, or the secondary card game can provide an award if the player wins a predetermined number of hands. In another embodiment, the secondary card game can provide an award if a specific hand is obtained at any time.

It should be appreciated that the secondary card game requiring a player decision can be based on various poker games, black jack or any suitable card game. That is, an object of this embodiment will be to obtain a set of cards that will beat the house or the hand that the secondary game holds.

Another embodiment of the gaming device of the present invention includes a primary game operable upon a wager by a player, and a secondary TETRIS™ type game, wherein a play provides a game block or other gaming element for the secondary TETRIS™ type game. The game block or gaming element may include a variety of shapes or colors. The game block of the secondary TETRIS™ game is provided by playing the primary game regardless of any event or outcome in the primary game. In other words, the secondary TETRIS™ game is independent of any event or outcome in the primary game.

Figure 6:
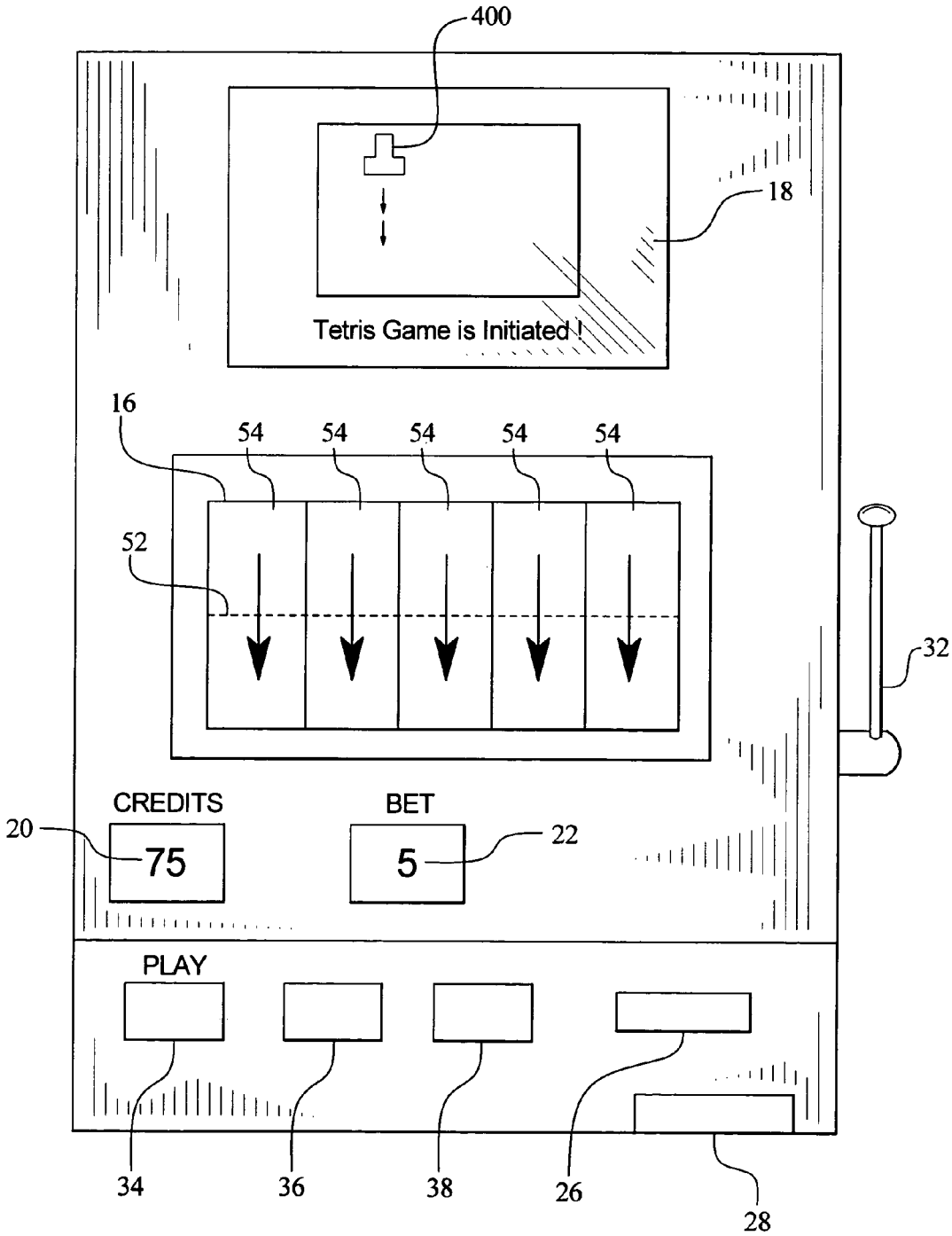
FIG. 6 is an elevation view of the display device of the present invention illustrating one slot machine embodiment of a primary slot game event and a secondary TETRIS™ type game event of the gaming device of the present invention.

Referring now to FIG. 6, after the primary game is initiated and while the reels of the primary game are spinning, the secondary TETRIS™ type game is activated and provides a gaming element, in this case a block 400. In this embodiment, the blocks can come in multiple shapes and colors.

Figure 7:
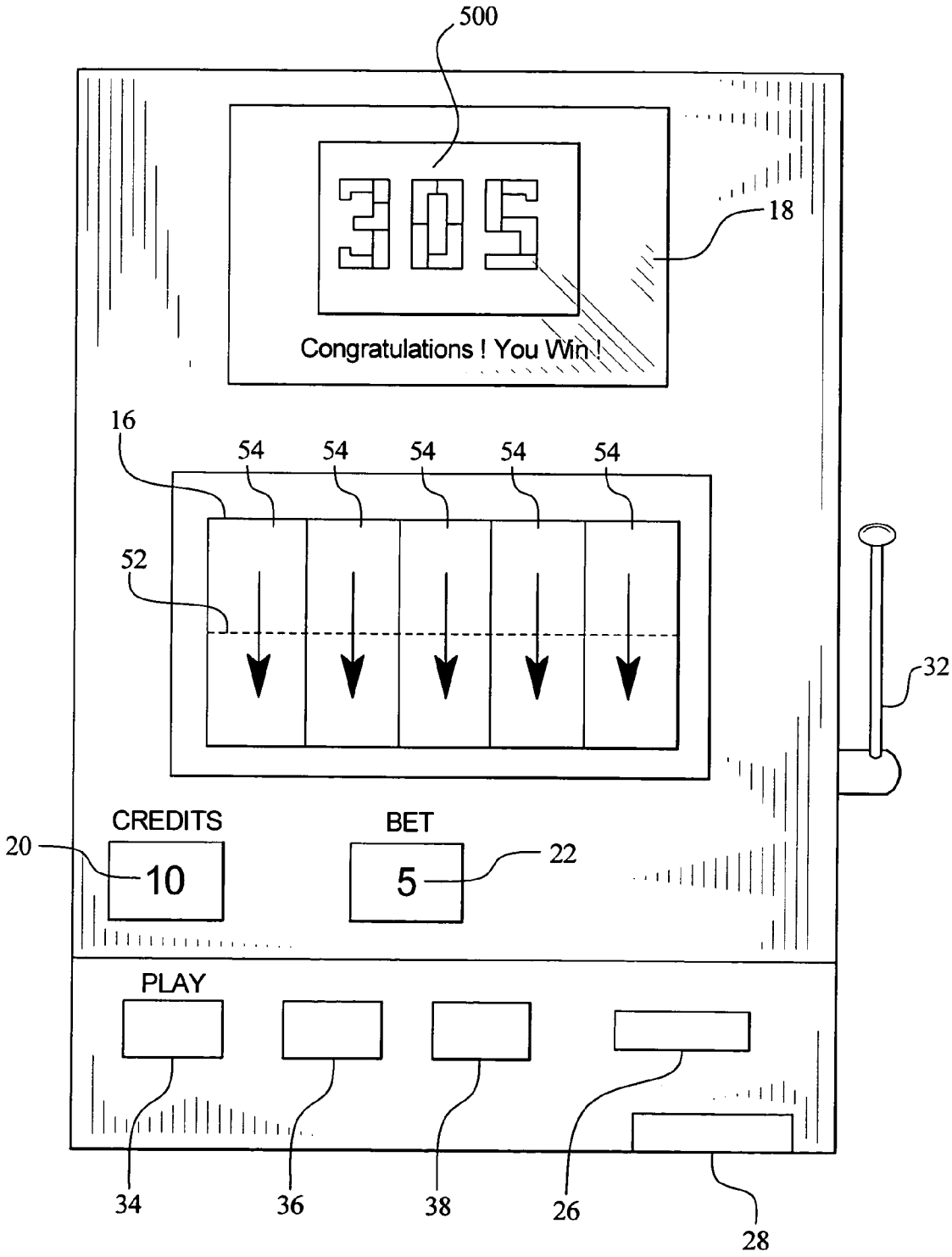
FIG. 7 is an elevation view of the display device of the present invention illustrating one slot machine embodiment of a primary slot game event and a secondary TETRIS™ type game event of the gaming device of the present invention having a winning outcome as the primary game is being played.

The secondary TETRIS™ type game can provide a secondary award through achieving a winning outcome in several ways. In one embodiment, the game blocks provided by playing the primary game may randomly or otherwise be provided until the secondary TETRIS™ type game achieves a winning outcome. The winning outcome can be based on the appearance of a predetermined number of blocks. For example, the blocks may randomly be provided, as illustrated as falling from the top of the display to form a pattern 500 using various colors or symbols as shown in FIG. 7. In achieving a winning outcome, the blocks may display a graphic message, reveal a hidden pattern, or construct a picture.

In this embodiment, no decision is made regarding the location of the appearing blocks. The secondary TETRIS™ type game determines the winning outcome and provides an associated award just by playing the primary game regardless of any event or outcome in the primary game. In another embodiment, the game blocks of the secondary TETRIS™ type game are provided, and the player may make a decision regarding placement of the game blocks in order to win an award when a predetermined objective is met. In this embodiment, one or more blocks are provide and are illustrated as appearing near the top, or otherwise, of the display after the primary game is initiated. The player is enabled to move the falling blocks before they reach the bottom of the display. In this embodiment, the blocks can be moved side to side or rotated. The objective can be to place the falling blocks in a slot that completes one or more lines of the secondary TETRIS™ type game. Once a line is complete, it can be removed from the game. The secondary TETRIS™ type game can provide an award after a predetermined number of lines have been removed. Alternatively, the secondary TETRIS™ type game may provide a different award if two, three, or four lines are removed at one time. Thus, in this embodiment, decision and strategy can help determine whether a winning outcome in the secondary game is achieved.

In another embodiment, the game blocks used in the secondary TETRIS™ type game fall from the top of the display to the bottom of the display at a rate or speed associated with number of times the primary game is played. In another embodiment, rate the game blocks of the secondary TETRIS™ game fall can be associated with an amount wagered in the primary game. For example, the player is usually able to make a better decision when the blocks fall at a slower rate. To promote larger wagers, the rate the blocks fall can decrease as the wager amount increases.

In an alternative embodiment, if the player obtains a predetermined outcome in the secondary game, then the player is provided with an opportunity for the player to achieve a wide area progressive jackpot. That is, if the player obtains a secondary game outcome, then the player's award is a number of "free pulls" of a progressive slot game. In another alternative embodiment, each of the provided gaming elements represents an opportunity for the player to achieve the wide area progressive jackpot. In this embodiment, each provided gaming element corresponds to a number of "free pulls" of the progressive slot game. In one embodiment, when the "free pulls" are executed, a game server may play the designated number of "free pulls" and stream the video results to the gaming device to be displayed to the player. In another embodiment, data or other information regarding the progressive slot game is downloaded to the gaming device and the "free pulls" of the progressive slot game are played real time from the gaming device.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one in put device;

a display device adapted to display a primary game and a secondary game, said secondary game having a winning outcome including a plurality of gaming elements; and at least one processor programmed to operate with said at least one input device and said display device to:

(a) display a play of the primary game upon a wager by a player, wherein if an outcome generated for the play of the primary game is a winning outcome, an award associated with the generated outcome is displayed and wherein the play of the primary game provides at least one of the gaming elements for the secondary game regardless of any event in the primary game and regardless of any generated outcome of the primary game; and (b) determine whether to display and provide the winning outcome in the secondary game, wherein said determination is based upon the plurality of gaming elements provided for playing the primary game a plurality of times.

2. The gaming device of claim 1, wherein the primary game includes a risk, skill, random or knowledge based event.

3. The gaming device of claim 1, wherein for each play of the primary game, one gaming element of the secondary game is provided regardless of any event in the primary game and regardless of any generated outcome of the primary game.

4. The gaming device of claim 1, wherein the number of gaming elements provided for the secondary game is based on an amount wagered in the primary game.

5. The gaming device of claim 1, wherein the at least one processor is programmed to operate with said at least one input device and said display device to enable the player to use the primary award as a separate wager for the secondary game.

6. The gaming device of claim 1, wherein the at least one processor is programmed to operate with said at least one input device and said display device to enable the player to place a separate wager on the secondary game.

7. The gaming device of claim 1, wherein the winning outcome of the secondary game is at least in part dependent on a decision by the player.

8. The gaming device of claim 1, wherein the winning outcome of the secondary game is based on a risk, skill or knowledge event.

9. The gaming device of claim 1, wherein the winning outcome of the secondary game is at least in part based on a random event.

10. The gaming device of claim 1, wherein the at least one processor is programmed to operate with said at least one input device and said display device to provide the player a secondary game award if the winning outcome is obtained in the secondary game.

11. The gaming device of claim 10, wherein the secondary game award is a progressive award.

12. The gaming device of claim 10, wherein the secondary game award is at least one activation of a wide area progressive slot game.

13. The gaming device of claim 1, which includes a primary pay table associated with the primary game and a secondary pay table associated with the secondary game.

14. The gaming device of claim 13, wherein the secondary pay table is based on any generated winning outcome in the primary game.

15. The gaming device of claim 13, wherein the secondary pay table is based on the wager made in the primary game.

16. The gaming device of claim 13, wherein the secondary pay table is based on a wager made in the secondary game.

17. The gaming device of claim 1, wherein the secondary game is displayed on a second display device different than the display device which displays the primary game.

18. The gaming device of claim 1, wherein the secondary game includes a secondary card game having at least one winning outcome, wherein the gaming elements include cards for the secondary card game.

19. The gaming device of claim 1, wherein the gaming elements include a plurality of different shaped blocks for the secondary game.

20. The gaming device of claim 1, wherein the secondary game includes a wide area progressive slot game having at least one winning outcome, wherein the game elements include activations of the secondary slot game.

21. A gaming device comprising:

at least one input device;

at least one display device adapted to display a primary game and a secondary card game having a winning outcome including a plurality of gaming cards; and at least one processor programmed to operate with said at least one input device and said at least one display device to:

(a) display a play of the primary game upon a wager by a player, wherein if an outcome generated for the play of the primary game is a winning outcome, an award associated with the generated outcome is displayed and wherein the play of the primary game provides at least one of the gaming cards for the secondary card game regardless of any event in the primary game and regardless of any generated outcome of the primary game; and (b) determine whether to display and provide the winning outcome in the secondary card game based upon the plurality of gaming cards provided for playing the primary game a plurality of times.

22. The gaming device of claim 21, which includes a secondary award associated with the winning outcome in the secondary card game.

23. The gaming device of claim 21, wherein the winning outcome occurs when the plurality of gaming cards forms a predetermined set.

24. The gaming device of claim 21, wherein the at least one processor is programmed to operate with said at least one input device and said display device to enable the player to use the plurality of gaming cards as part of a set for the secondary card game.

25. The gaming device of claim24, wherein the at least one processor is programmed to operate with said at least one input device and said display device to enable the player to compete against the gaming device in the secondary card game using the set of the plurality of gaming cards.

26. The gaming device of claim 21, wherein the at least one processor is programmed to operate with said at least one input device and said display device to enable the player to place an additional wager on the secondary card game.

27. The gaming device of claim 21, wherein the secondary card game is a poker game.

28. The gaming device of claim 21, wherein the secondary card game is a blackjack game.

29. The gaming device of claim 21, wherein the plurality of gaming cards can be replaced with other cards.

30. A method of operating a gaming device, said method comprising:

(a) receiving a wager by a player;

(b) initiating a primary game upon receiving the wager by the player;

(c) generating an outcome in the primary game;

(d) if the generated outcome in the primary game is a winning outcome, displaying an award associated with the generated outcome in the primary game;

(e) providing at least one gaming element of a secondary game regardless of any event in the primary game and regardless of any generated outcome of the primary game;

(f) determining whether a winning outcome occurs in the secondary game, wherein the winning outcome is based on the gaming elements of the secondary game that are provided for playing the primary game a plurality of times; and (g) repeating steps (b) to (f) upon another wager by the player.

31. The method of claim 30, wherein said steps are provided to the player through a data network.

32. The method of claim 31, wherein the data network is an internet.

33. A method of operating a gaming device, said method comprising:

(a) receiving a wager by a player;

(b) initiating a primary game upon receiving the wager by the player;

(c) generating an outcome in the primary game;

(d) if the generated outcome in the primary game is a winning outcome, displaying an award associated with the generated outcome in the primary game;

(e) providing at least one gaming card of a secondary game regardless of any event in the primary game and regardless of any generated outcome of the primary game;

(f) determining whether a winning outcome occurs in the secondary game, wherein the winning outcome is based on the gaming cards of the secondary card game that are provided for playing the primary game a plurality of times; and (g) repeating steps (b) to (f) upon another wager by the player.

34. The method of claim 33, wherein said steps are provided to the player through a data network.

35. The method of claim 34, wherein the data network is an internet.

36. The gaming device of claim 1, wherein the number of gaming elements provided for the secondary game is selected from the group consisting of: a constant number, a randomly determined number and a predetermined number.

37. The gaming device of claim 1, which includes a plurality of secondary games each having a winning outcome including a plurality of gaming elements, wherein the play of the primary game provides at least one of the gaming elements for at least one of the secondary games regardless of any event in the primary game and regardless of any generated outcome of the primary game.

38. The gaming device of claim 1, which includes a plurality of secondary games each having a winning outcome including a plurality of gaming elements, wherein the play of the primary game provides at least one of the gaming elements for said plurality secondary games regardless of any event in the primary game and regardless of any generated outcome of the primary game.

39. The method of claim 30, wherein the primary game includes a risk, skill, random or knowledge based event.

40. The method of claim 30, wherein for each play of the primary game, one gaming element of the secondary game is provided regardless of any event in the primary game and regardless of any generated outcome of the primary game.

41. The method of claim 30, wherein the number of gaming elements provided for the secondary game is based on an amount wagered in the primary game.

42. The method of claim 41, which includes enabling the player to use the primary award as a separate wager for the secondary game.

43. The method of claim 30, which includes enabling the player to place a separate wager on the secondary game.

44. The method of claim 30, wherein the winning outcome of the secondary game is at least in part dependent on a decision by the player.

45. The method of claim 30, wherein the winning outcome of the secondary game is based on a risk, skill or knowledge event.

46. The method of claim 30, wherein the winning outcome of the secondary game is at least in part based on a random event.

47. The method of claim 30, which includes providing the player a secondary game award if the winning outcome is obtained in the secondary game.

48. The method of claim 47, wherein the secondary game award is a progressive award.

49. The method of claim 47, wherein the secondary game award is at least one activation of a wide area progressive slot game.

50. The method of claim 30, which includes a primary pay table associated with the primary game and a secondary pay table associated with the secondary game.

51. The method of claim 50, wherein the secondary pay table is based on any winning outcome generated in the primary game.

52. The method of claim 50, wherein the secondary pay table is based on the wager made in the primary game.

53. The method of claim 50, wherein the secondary pay table is based on a wager made in the secondary game.

54. The method of claim 30, wherein the gaming elements include a plurality of different shaped blocks for the secondary game.

55. The method of claim 30, wherein the secondary game includes a wide area progressive slot game having at least one winning outcome, wherein the game elements include activations of the secondary slot game.

56. The method of claim 30, wherein the number of gaming elements provided for the secondary game is selected from the group consisting of: a constant number, a randomly determined number and a predetermined number.

57. The method of claim 30, which includes providing at least one of the gaming elements for at least one of a plurality of secondary games regardless of any event in the primary game and regardless of any generated outcome of the primary game.

58. The method of claim 30, which includes providing at least one of the gaming elements for a plurality of secondary games regardless of any event in the primary game and regardless of any generated outcome of the primary game.

59. The method of claim 33, which includes a secondary award associated with the winning outcome in the secondary card game.

60. The method of claim 33, wherein the winning outcome occurs when the plurality of gaming cards forms a predetermined set.

61. The method of claim 33, which includes enabling the player to use the plurality of gaming cards as part of a set for the secondary card game.

62. The method of claim 61, which includes enabling the player to compete against the gaming device in the secondary card game using the set of the plurality of gaming cards.

63. The method of claim 33, which includes enabling the player to place an additional wager on the secondary card game.

64. The method of claim 33, wherein the secondary card game is a poker game.

65. The method of claim 33, wherein the secondary card game is a blackjack game.

66. A method of operating a gaming system, said method comprising:

(a) receiving a first wager amount by a first player;

(b) initiating a first primary game upon receiving the first wager amount by the first player;

(c) providing at least one gaming element of a secondary game regardless of any event in the first primary game and regardless of any outcome of the first primary game;

(d) determining whether a winning outcome occurs in the secondary game, wherein the winning outcome is based, at least in part, on the gaming elements of the secondary game that are provided for playing the first primary game; and (e) if the determination is that the winning outcome does not occur in the secondary game:

(i) receiving a second wager amount by a second player;

(ii) initiating a second primary game upon receiving the second wager amount by the second player;

(iii) providing at least one gaming element of the secondary game regardless of any event in the second primary game and regardless of any outcome of the second primary game; and (iv) determining whether a winning outcome occurs in the secondary game, wherein the winning outcome is based, at least in part, on the gaming elements of the secondary game that are provided for playing the second primary game.

67. The method of claim 66, wherein for each play of the first primary game, one gaming element of the secondary game is provided regardless of any event in the first primary game and regardless of any outcome of the first primary game.

68. The method of claim 66, wherein the number of gaming elements provided for the secondary game is based on the amount wagered.

69. The method of claim 66, which includes enabling the placement of a separate wager on the secondary game.

70. The method of claim 66, which includes providing a secondary game award if the winning outcome is obtained in the secondary game.

71. The method of claim 70, wherein the secondary game award is a progressive award.

72. The method of claim 70, wherein the secondary game award is at least one activation of a wide area progressive slot game.

73. The method of claim 66, wherein the number of gaming elements provided for the secondary game is selected from the group consisting of: a constant number, a randomly determined number and a predetermined number.

74. The method of claim 66, which includes providing at least one of the gaming elements for at least one of a plurality of secondary games regardless of any event in the first primary game and regardless of any outcome of the first primary game.

75. The method of claim 66, which includes providing at least one of the gaming elements for a plurality secondary games regardless of any event in the first primary game and regardless of any outcome of the first primary game.

76. The method of claim 66, wherein the first primary game and the second primary game are the same game.

77. The method of claim 66, wherein the winning outcome in the secondary game is based, at least in part, on the gaming elements of the secondary game that are provided for playing the second primary game and based, at least in part, on the gaming elements of the secondary game that are provided for playing the first primary game.

78. The method of claim 66, which is provided through a data network.

79. The method of claim 78, wherein the data network is an internet.

* * * * *

UNITED STATES PATENT AND TRADEMARK OFFICE

CERTIFICATE OF CORRECTION

PATENT NO. : 7,513,828 B2
APPLICATION NO. : 10/780088
DATED : April 7, 2009
INVENTOR(S) : Binh T. Nguyen et al.

It is certified that error appears in the above-identified patent and that said Letters Patent is hereby corrected as shown below:

In Column 7, Lines 42-43, change “such a free games” to --such as free games--.

In Column 10, Lines 45-46, change “display deices controlled by” to --display devices controlled by--.

In Column 11, Lines 4-5, change “combination of play the primary” to --combination of play of the primary--.

In Column 14, Line 22, change “plurality of gaming element or cards” to --plurality of gaming elements or cards--.

In Column 14, Lines 24-25, change “provides an element a competition” to --provides an element of competition--.

In Column 14, Line 63, change “black jack” to --blackjack--.

In Claim 1, Column 16, Line 23, change “one in put device;” to --one input device;--.

In Claim 38, Column 19, Line 14, change “said plurality secondary games” to --said plurality of secondary games--.

In Claim 75, Column 22, Line 2, change “for a plurality secondary games” to --for a plurality of secondary games--.

Signed and Sealed this

Thirtieth Day of June, 2009

John Doll

JOHN DOLL
*Acting Director of the United States Patent and Trademark Office*